United States Patent [19]

Potucek

[11] Patent Number: 4,858,457

[45] Date of Patent: Aug. 22, 1989

[54] MACHINE AND METHOD FOR MAKING CONCRETE REINFORCING BARS

[76] Inventor: Frank R. Potucek, 612 48th St. Court W., Palmetto, Fla. 34221

[21] Appl. No.: 192,990

[22] Filed: May 12, 1988

[51] Int. Cl.[4] ..... B21H 8/02

[52] U.S. Cl. ..... 72/187; 72/194; 72/224

[58] Field of Search ..... 52/736, 737, 738, 739, 52/740; 72/185, 187, 194, 224

[56] References Cited

U.S. PATENT DOCUMENTS

| | | | |
|---|---|---|---|
| 371,424 | 10/1887 | Clifford et al. | 72/224 |
| 542,206 | 7/1895 | Ransome | 52/736 |
| 1,100,742 | 6/1914 | Kane | 52/739 |
| 1,551,863 | 9/1925 | Berry | 52/737 |
| 3,364,957 | 1/1968 | Guess | 72/185 |
| 3,494,164 | 2/1970 | Rehm et al. | 72/187 |
| 3,996,780 | 12/1976 | German | 72/187 |
| 4,034,587 | 7/1977 | Schwarz | 72/194 |
| 4,776,195 | 10/1988 | Fukuhara et al. | 72/224 |

*Primary Examiner*—Lowell A. Larson

*Attorney, Agent, or Firm*—Joseph C. Mason, Jr.; Ronald E. Smith

[57] ABSTRACT

A machine for making concrete reinforcing bars, known as rebars, from wire stock having a round cross section. A preform roller station cold works the round cross section of the wire stock into the shape of a polygon. A first form roller station cold works the polygonal cross section into a cross section having a central core and radial fin members extending therefrom. A second form roller station further reduces the diameter of the central core, and further increases the radial extent of the fin members. A third form roller station reduces the core still further, and again increases the radial extent of the fins, imparts shoulder members that provide an anti-longitudinal slip function at preselected intervals along the extent of the rebar, and roughens the rebar.

43 Claims, 1 Drawing Sheet

MACHINE AND METHOD FOR MAKING CONCRETE REINFORCING BARS

TECHNICAL FIELD

This invention relates, generally, to machines that make concrete reinforcing bars from wire stock, and more particularly relates to a machine that makes bars having radially extending fin members formed along their extent.

BACKGROUND ART

Concrete reinforcement bars, known as rebars, are used as their name expresses, i.e., to reinforce concrete structures.

Concrete has poor tensile strength; accordingly, good engineering practice mandates the use of rebars in applications where the tensile strength of the concrete is inadequate and requires supplementation.

The rebars now in widespread use are made by a well-known hot rolling technique. They are round in transverse section and thus present a minimal surface area to the concrete which must adhere thereto. They have a tensile strength of about 40,000–60,000 p.s.i. Accordingly, conventional rebars are at least adequate to fulfil their intended unambitious purpose. Their relatively low tensile strength and their other uninspiring statistics are a result of the hot rolling process by which they are made.

A common problem with conventional rebars (other than their low tensile strength, high weight and minimal surface area) is their tendency to slide out of position after concrete has been poured around them, i.e., after they have been embedded in the concrete.

This longitudinal or axial slip may be countered by forming upwardly projecting ridge members on the outer surface of the rebar.

Concrete weights about one-tenth of a pound per cubic inch, whereas rebars, being made of steel, weigh about three-tenths of a pound per cubic inch. Thus, rebar-reinforced concrete is quite heavy. Perhaps more importantly, since steel and concrete expand and contract at different ratios in response to heating and cooling, respectively, rebar-reinforced concrete will crack during periods of rapid temperature changes more severely than non-reinforced concrete.

There is a need, therefore, for a machine that can make rebar that is higher in tensile strength yet lighter in weight than conventional rebar, that makes rebars having enhanced non-slip properties, and which makes rebars that, when embedded in concrete, will cause appreciably less cracking than rebars made with the machines of the prior art.

All of the earlier rebar-making machines known to the present inventor produce rebars by a hot-rolling process, as aforesaid. Hot rolling results in rebars of low tensile strength, as aforesaid, and wastes steel. Patents disclosing hot rolling machines and methods, when considered one at a time or as a whole, neither teach nor suggest to those skilled in the art of rebar-making machines how a machine could be built that would produce rebars not subject to the limitations of conventional hot-rolled rebars.

All of the prior patents, in the field of rebars, known to the present inventor, are as follows: U.S. Pat. Nos. 4,229,501 to Kern (1980); 4,119,764 to Mizuma et. al. (1978); 3,979,186 to Mizuma (1976); 3,561,185 to Finsterwalder et. al. (1971); 3,415,552 to Howlett (1968); 3,335,539 to Soretz (1967); 3,312,035 to VanKoot (1967).

DISCLOSURE OF INVENTION

The present disclosure relates to a machine that carries out an inventive method and makes rebars that weigh only half as much as conventional rebars. The machine slashes by about 50% the amount of wire required to make rebars, but there is no concomitant sacrifice of tensile strength in the rebar produced. On the contrary, the revolutionary machine produces rebars having a tensile strength double or triple the tensile strength of hot-rolled rebars.

Moreover, the machine makes rebars having a surface area 15–85 percent greater than the surface area of conventional rebars. This enables the concrete to adhere more effectively to the rebars, thereby greatly reducing longitudinal slip.

The machine also forms shoulder members at longitudinally spaced intervals along the extent of the rebars made by it, to further inhibit longitudinal slip.

Due to the reduced amount of material in the rebars made by the novel machine, the rebars respond more quickly to temperature changes, thereby expanding or contracting at a rate closer to the corresponding rate of concrete and thereby causing fewer and less extensive cracks in the concrete.

All embodiments of the novel machine produce rebars having plural fin members that extend the entire length thereof; the fin members radiate from a central core, and the central core has a reduced diameter relative to the diameter of a conventional rebar of round cross section. All embodiments of the novel machine produce rebars having but half the weight of conventional rebars, using but half the quantity of wire stock, having increased surface areas, increased tensile strength, and the other advantages mentioned hereinabove, and more advantages that will become apparent to this disclosure proceeds.

A first embodiment of the machine has a preform roller station that provides the wire stock passing therethrough with as many longitudinally extending substantially flat surfaces as there are roller members at said station, and three form roller stations that further cold work the rebar.

More specifically, in the first embodiment, the first form roller station changes each longitudinally extending generally flat surface into a longitudinally extending bight means that is disposed intermediate the radially extending sidewalls of a pair of fin members flanking said bight means, i.e., the first form roller station cold works the wire stock with the convex annular edges of plural form roller members that are equidistantly and circumferentially spaced about the path of travel of the wire, i.e., about the longitudinal axis of symmetry of said wire.

The convex annular edges of said form roller members forms said concave bight means along the extent of said wire stock and the fin members form in response to the radially inwardly-converging pressures collectively created by said form rollers. Since the steel at the interior of the wire stock is substantially non-compressible, it deforms or flows into the space between the form rollers, thereby creating as many fin members and intermediate concave bight means as there are form roller members.

The preferred number of preform and form roller members is five, although this invention also teaches or suggests machines having as few as three preform and form roller members, up to eleven or more.

The fins made by the first stage of an illustrative embodiment of the novel machine are five in number, spaced about the wire's central core at about 100 degree angles relative to one another, and are tapered downwardly from their proximal to their distal free ends. The surface area of the rebars produced by said first form roller station has a surface area about 17 percent greater than the surface area of a rebar of similar length having a round cross section.

Still referring to the first embodiment, a second form roller station is spaced longitudinally from the first. The diameter of the core is reduced still further, and the material flowing out of the central core flows, in equal proportions, into the fin members, thereby increasing their respective radial extents. The roller members of the second station provide pressure sufficient to form fins disposed about 85 degrees apart. The fin members are tapered to a lesser degree than the fins of the wire exiting the first form roller station.

A third form roller station is longitudinally spaced from the second; the fins produced by said third form roller station are of uniform width along their radial extent, i.e., they are not tapered as are the fin members exiting the preceding form rolling stations.

Moreover, the fins exiting the third and final form roller station have a common, uniform width equal to about half the diameter of the central core of the formed wire stock.

The angle between adjacent fins, i.e., the fin-included angle, is about 72 degrees for the wire stock exiting said third form roller station.

The overall diameter of the rebars exiting the third form roller station is greater than the diameter of the rebars entering the preceding stages, because the core material is forced into the fins, thereby extending them, as aforesaid.

More precisely, the diameter of an imaginary circle coincident with the radially outermost edges of the fins of the rebars exiting the first form roller station is about three times the diameter of the central core of said rebars, the diameter of an imaginary circle coincident with the radially outermost edges of the fins of the rebars exiting the third form roller station is about four times the diameter of the central core of said rebars, and the same ratio relative to the rebars exiting the second or middle form roller station is greater than 3:1 but less than 4:1.

Increasing the overall rebar diameter to central core diameter from the 3:1 ratio to 4:1 increases the surface area of the rebar to a surface area about 86 percent greater than the surface area of a rebar having a round cross section. This is a surface area about 60 percent greater than that of the rebar as it exits the first form roller station.

Shallow, transversely disposed notches are formed at equidistantly spaced intervals in the annular convex edges of the form rollers of the final form roller station. Each notch has its greatest depth at its bight region and the depth decreases linearly along the radial extent of a pair of notch arms that diverge radially from said bight region.

Those portions of the wire stock coming into registration with the shallow notches are compressed and deformed less than the remaining portion of the wire stock. Specifically, a concave shoulder member is produced by each notch. The bight portion of each shoulder member is raised with respect to the bight region of the wire unaffected by a notch. A pair of raised arm members diverge in a radial direction from each bight region, decreasing gradually in height until their respective radially outermost ends merge in a feather edge with their associated fin sidewalls. The shoulder members are longitudinally spaced along the extent of the rebar, the amount of spacing being determined by the diameter of the form rollers and the circumferential spacing of the notches formed in the annular edges thereof.

The final form rollers may also be sand blasted, acid washed, or roughened by other means so that the microfinish of the rebars produced by the novel machine is substantially increased over that of conventional rebars.

All of the form roller members are movably mounted so that the wire stock may be submitted to differing pressures as desired. Each set of form rollers is thus capable of assuming the first collective position where each form roller of the set is in its radially outermost position where the lowest amount of pressure is applied to the wire stock, a second collective position where each form roller of the set is in its radially innermost position where the highest amount of pressure is applied and a plurality of collective positions of functional adjustment therebetween where pressures between said limits are applied.

It is an object of this invention to pioneer the art of machines for making rebars by disclosing, for the first time anywhere in the world, a machine that cold works wire stock and produces rebars having plural fins radiating from a central core with concave bight regions extending between each pair of adjacent fins, with all of the advantages thereof as briefly summarized hereinabove and more.

The invention accordingly comprises the features of construction, combination of elements and arrangement of parts that will be exemplified in the descriptions set forth hereinafter and the scope of the invention will be set forth in the claims.

BRIEF DESCRIPTION OF DRAWINGS

Similar reference numerals refer to similar parts throughout the several views of the drawings.

BEST MODES FOR CARRYING OUT THE INVENTION

Figures 1, 2, 3, 3A, 4, 5, 6, 7, 8:
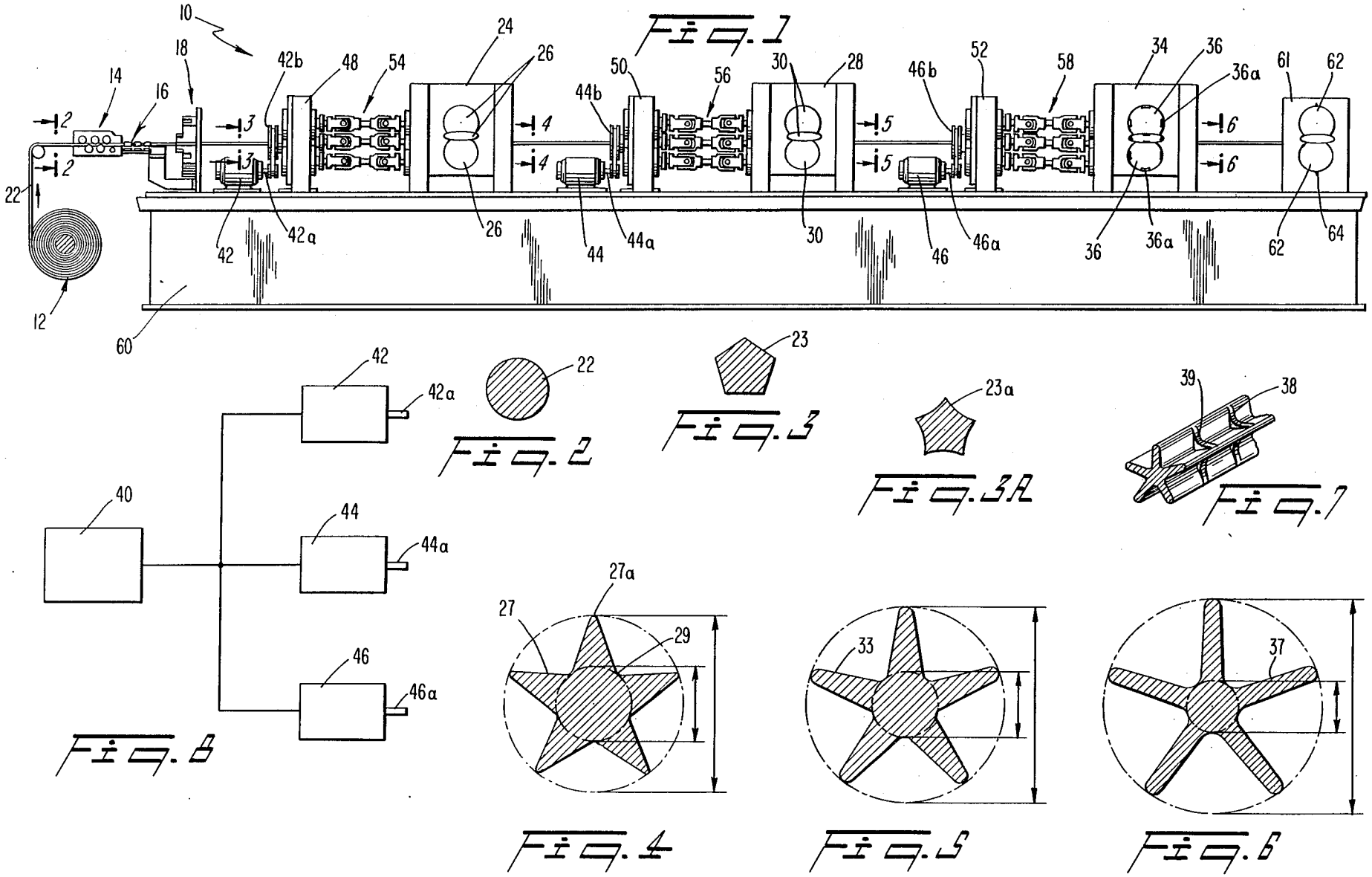
FIG. 1 is a conceptual, side elevational view of the novel machine.
FIG. 2 is a sectional view taken along line 2—2 in FIG. 1 of wire stock entering the preform roller station.
FIG. 3 is a sectional view taken along line 3—3 in FIG. 1.
FIG. 3A shows an alternate form of the wire stock produced by alternate preform rollers.
FIG. 4 is a sectional view taken along line 4—4 in FIG. 1.
FIG. 5 is a sectional view taken along line 5—5 in FIG. 1.
FIG. 6 is a sectional view taken along line 6—6 in FIG. 1.
FIG. 7 is a perspective view of a rebar produced by following the steps of the novel method.
FIG. 8 is a block diagram showing how the motors associated with the three form roller stations are synchronized.

Referring now to FIG. 1, it will there be seen that a machine that illustratively embodies the present invention and which is capable of performing the inventive method is denoted as a whole by the reference numeral 10.

Machine 10 includes a supply of wire stock 12 that is stored in a coiled configuration. A wire straightener means in the form of a vertical set of cooperating roller members 14 and a horizontally disposed set of cooperating roller members 16 straightens the wire stock and delivers it to preform roller station 18.

Preform roller station 18 includes at least three roller members; in the preferred embodiment, the number of preform roller members is five. Each preform roller member 20 has a substantially flat annular edge and may impart a flat to the wire stock, thereby changing by cold rolling the round cross section (FIG. 2) of the wire 22 into a polygonal configuration such as the preferred regular pentagon configuration 23 (FIG. 3).

Alternatively, each roller 20 may have a slight convexity with a radius of about 0.010 inch to produce a wire 23*a* (FIG. 3A) having a corresponding concavity where worked by said preform roller members 20.

The preformed wire is fed by the preform roller members 20 to the first form roller station 24. Five form rollers, collectively designated 26, form wire 22 into a tapered fin star cross section designated 27 (FIG. 4). Each form roller 26 is advantageously centered with respect to its associated flat or its associated concavity. The centering effect of the concavity has utility and the use of preform roller members 20 having slightly convex annular edges is therefore preferred.

Each form roller member 26 has a convex annular edge; the preferred radius of the annular edge is about 0.003–0.006 inch. The center of each convex edge is centered with respect to each flat or concavity as aforesaid; accordingly, five longitudinally extending fins having rounded outer edges 27*a* are formed. A longitudinally extending concave bight region 29 is formed intermediate each fin, there being five bights 29 in the illustrated embodiment. Each bight has a radius of about 0.003–0.006 inch.

The fins exiting the first form roller station are angularly disposed about 100 degrees apart from one another. The form roller members 26 are in their radially outermost position.

Wire 22 next travels to a second form roller station 28 which includes five roller members 30 disposed closer to one another so as to impart increased radially-inwardly directed forces to the wire stock vis a vis the form rollers 26 of the first form roller station. Form roller members 26 are positioned about midway between their radially outermost and radially innermost positions.

The annular edges of form rollers 30 are also convex in configuration, have a radius of about 0.003–0.006 inch, and are centered with respect to their associated bights 29.

The resulting cross section of wire 22 is denoted 33 (FIG. 5). From a comparison of stars 27 and 33, it is apparent that the central core of star 33 has a diameter less than that of the central core of star 27. The material (wire stock) in the central core of star 27 is forced by the novel cold rolling process into the fins of the star. Accordingly, the radial extent of each of the fins of star 33 is greater than the radial extent of the fins of star 27. If the overall diameter of either star 27 or 33 is defined as the diameter of an imaginary circle coincident with the radially outermost edges of its fins, and if the central core of each star 27 or 33 is defined as that part of the star which is not a part of a fin, then the ratio of the overall diameter to the central core diameter in star 27 is about 3:1 or at least greater than 2:1 and the same ratio in star 33 is greater than 3:1 but less than 4:1.

The final forming stage is denoted 34 as a whole and includes five form roller members collectively designated 36, each of which has a convex annular edge with a radius of about 0.003–0.006 inch. Form rollers 36 are closer together than form rollers 30 so as to impart still greater compressive forces to the wire stock. The position of form rollers 36 represents their radially innermost position. The fin members of star 37 (FIG. 6), produced by form rollers 36, are 72 degrees apart from one another.

Still further wire stock has been forced by said form rollers 36 out of the central core of the wire stock and as a result, the radial extent of the fin members of star 37 is even greater than that of star 33 and the core diameter is reduced as well. The above-mentioned ratio is about 4:1 in the rebar shown in FIG. 6.

Measurement techniques have determined that the surface area of star 27 (FIG. 4) is about 17 percent greater than the surface area of round-in-section rebar 22 (FIG. 2) and that the surface area of star 37 (FIG. 5) is about 86 percent greater than that of round-in-section rebar.

Form roller members 36 are also provided with shallow, transversely disposed notches 36*a* along their annular edges at equidistantly spaced intervals; transverse shoulder members 38, shown in FIG. 7, are thus produced, and said members 38 resist longitudinal slippage. Each notch 36*a* has its greatest depth at its bight region and thus each shoulder 38 is raised highest at its concave bight region 39. The depth of each notch 36*a* linearly decreases along its radial extent so that each shoulder 38 has diverging radial arms that gradually merge with their associated fins as shown in FIG. 7.

In a five-finned rebar, all five roller members 36 may be provided with shoulder-forming notches.

The convex annular edge of each form roller 36 is acid washed, sand blasted, machined, peened or roughened by other suitable means to have a microfinish of 30–120 microfinish units. Conventional rebars (which have a round cross section as at 22 in FIG. 2), have a microfinish of about 30 microfinish units. As such, they have a high tendency to slip along a path of travel coincident with their longitudinal axis of symmetry. The roughened microfinish applied to the rebars by this inventive machine further reduces the amount of longitudinal slip.

All three form roller stations 24, 28 and 34 are operated in synchronous relation to one another; this is accomplished by the means shown in FIG. 8. A controller or computer means 40 is electrically connected as shown to motors 42, 44 and 46; each motor has an output shaft denoted 42*a*, 44*a* and 46*a*, respectively, that transmits power via belt drive means 42*b*, 44*b* and 46*b* (FIG. 1) to gear box members 48, 50 and 52, respectively. The gear box members, in turn, drive their associated roller members via universal-joint drive assemblies denoted 54, 56 and 58, generally.

The parts of the novel machine may be mounted on a support surface such as a floor or upon a table means of the type denoted 60 in FIG. 1.

The rebars are cut by the cutting wheel members which collectively form the cutting station 61 of this invention, shown in FIG. 1. Each cutting wheel 62 has at least one conically or other suitably shaped cutting means 64 formed on its annular periphery and all five cutting wheels 62 rotate synchronously so that their respective cutting means 64 cooperatively abrade and cut the worked wire passing therethrough. In this manner, the machine need not stop as the elongate wire stock is cut into equal lengths of rebar.

Another advantage of this invention is that the novel cold-working method hereof produces rebars having a substantially uniform tensile strength along their respective lengths, said uniform tensile strength being double or triple that of prior art rebars while weighing half as much, as aforesaid.

Further embodiments of this invention will now be described.

It is possible to eliminate intermediate form roller station 28 and its associated parts, i.e., one may elect to produce the rebar of FIGS. 6 and 7 directly after producing the configuration of FIG. 4. Accordingly, FIG. 1 should be understood as fully disclosing this second embodiment of the invention. For that matter, it should be equally understood that additional intermediate form roller stages could be employed. The pressures required to be supplied at each station of cooperatively positioned form roller members would diminish as each additional station is added, and increase as each station is deleted. Moreover, the size of the angle between the fins and the core diameter of the wire will also decrease with each successive station. For example, in the embodiment of FIG. 1, the angular disposition between the fins exiting the first form roller station 24 has been disclosed as being about 100 degrees, the angular disposition between fins exiting the second station 28 has been disclosed as being about 85 degrees, and the final angular relation of fins exiting station 34 has been disclosed as being 72 degrees. However, again, the second station can be eliminated entirely and the fin-included angle may decrease from 100 to 72 degrees at a single station.

Importantly, it is believed that 72 degrees is about the minimum size of the angle between radial fins (the fin-included angle) of a five pointed star. The maximum fin-included angle for a five pointed star is believed to be about 98 degrees. This invention, thus, not only discloses the world's first cold rolling machine for making rebars, it also includes important teachings concerning the range of angular dispositions between the fins of rebars produced by the novel machine, which range is a function of the radial positioning of the form roller members, as pointed out hereinabove.

The rebars made by the novel machine have a uniform tensile strength along their extent of 120,000–150,000 p.s.i., weigh only half as much, present significantly greater surface area to the concrete and have numerous other advantages over prior art rebars.

The tensile strength of the rebars can be increased to 300,000 p.s.i. by increasing the carbon content of the wire stock.

Those skilled in the art of machine design, upon reading this disclosure, will be able to design machines that perform the same steps as the machines disclosed herein but which may differ in structural detail from the suggested structure disclosed herein. Accordingly, as provided by law, claims appended hereto also cover the inventive method, or process, carried out by the machines of this invention.

The method of making rebars includes the steps of procuring a substantially continuous length of wire stock from a supply thereof, straightening the same, forming plural, longitudinally extending flats or concavities therealong, and subsequently forming successively deeper, longitudinally extending, concave bights therein between rounded edge fins that flow radially outwardly in response to successively increasing inwardly-directed converging forces.

The method further includes applying less pressure to longitudinally spaced portions of the wire stock to create shoulder members that are raised with respect to the fully formed portions of said wire stock and which are more fully described hereinabove.

The final step of the method includes cutting the wire stock into individual rebars having structural features and qualities resulting therefrom that were heretofore unknown.

INDUSTRIAL APPLICABILITY

Millions of tons of rebars are used annually. The rebars made by the present machine, when used by the concrete construction industry, will save materials and reduce shipping costs, without sacrificing rebar strength.

The pioneering breakthrough nature of this major invention clearly entitles the claims appended hereto to broad interpretation, as a matter of law, in order to protect the heart or essence of the invention.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A machine for making rebars, comprising:

a supply of wire stock having a substantially round cross section;

a preform roller station including a plurality of preform roller members having annular edges;

means for feeding a continuous length of said wire stock from said supply to said preform roller station;

said plurality of preform roller members being equidistantly and circumferentially spaced relative to a path of travel of said wire stock;

said plurality of preform roller members imparting a generally polygonal cross section to said wire stock;

a first form roller station longitudinally spaced apart from said preform roller station;

said first form roller station including a first plurality of form roller members having convex annular edges;

said first plurality of form roller members being equidistantly and circumferentially spaced relative to a path of travel of said wire stock;

said first plurality of form roller members forming said wire stock into a wire stock having a central core and a plurality of equidistantly spaced, tapered fin members radiating therefrom;

each of said fin members having a rounded terminus, and said fin members having a common dimension and configuration;

the diameter of said central core being about one-third the diameter of an imaginary circle coincident with radially outermost edges of said fin members;

a plurality of elongate, circumferentially spaced bight regions formed along the extent of said wire stock, there being as many bight regions as there are form rollers in said first plurality of form roller members;

a second form roller station longitudinally spaced apart from said first form roller station;

said second form roller station including a second plurality of form roller members having convex annular edges;

said second plurality of form roller members being equidistantly and circumferentially spaced relative to a path of travel of said wire stock;

said second plurality of form roller members further forming said wire stock by further reducing the diameter of said central core, further reducing the amount of taper of said fin members, and further lengthening the radial dimension of said fin members relative to the core diameter, taper, and fin length imparted to said wire stock by said first plurality of form roller members;

a plurality of transversely disposed notch members formed on the convex annular edges of each of said second plurality of roller members;

said notch members being equidistantly and circumferentially spaced about the respective annular edges of said second plurality of form roller members; and a plurality of transversely disposed, longitudinally spaced, raised shoulder members being formed along the extent of said wire stock by said notch members;

each of said raised shoulder members extending across its associated bight region.

2. The machine of claim 1, wherein the annular edges of said second plurality of form roller members are roughened by a roughening means and have a microfinish of 30–120 microfinish units to impart a corresponding microfinish to wire stock worked by said roller members.

3. The machine of claim 4, wherein said roughening means is acid washing.

4. The machine of claim 1, further comprising a cutting station including a plurality of cutting roller members disposed radially about a path of travel of said wire stock, each of said roller members having at least one cutting means formed on its annular edge.

5. The machine of claim 1, wherein the number of said preform roller members is five and wherein said preform roller members having substantially flat annular edges and impart longitudinally extending flats along the extent of said wire stock.

6. The machine of claim 1, wherein the number of said preform roller members is 5 and wherein said preform roller members have slightly convex annular edges and impart longitudinally extending concavities along the extent of said wire stock.

7. The machine of claim 6, wherein said preform roller member convex annular edges and said wire stock concavities have a radius of about 0.010 inch.

8. The machine of claim 1, wherein the number of said first plurality of form roller members is five and wherein said form roller members impart a generally five-pointed star cross-sectional configuration to said wire stock.

9. The machine of claim 8, wherein said star cross section includes five fin members spaced about 100 degrees apart, and wherein said fin members are tapered downwardly along their radial extent.

10. The machine of claim 9, wherein the surface area of a predetermined length of rebar made by said machine is about 17 percent greater than the surface area of a like length of rebar having a round cross section.

11. The machine of claim 9, wherein rebar made by said machine is cold-worked and as a result thereof has a tensile strength of about 120,000–150,000 pounds per square inch.

12. The machine of claim 8, further comprising five equidistantly and circumferentially spaced longitudinally extending concave bight means formed in said central core along the extent of said wire stock, by said form roller members each of said bight means being intermediate a pair of contiguous fin members.

13. The machine of claim 8, wherein the weight and quantity of wire stock in a preselected length thereof is about one-half the weight and quantity of wire stock of the same length having a round cross section.

14. The machine of claim 1, further comprising a plurality of longitudinally extending concave bight means formed along the extent of said wire stock by said form roller members, there being as many bight means as there are fin members, and each of said bight means being formed in said central core intermediate a pair of contiguous fin members.

15. The machine of claim 14, wherein the convex annular edges of said form roller members and said bight means formed thereby have a radius of about 0.003–0.006 inch.

16. The machine of claim 1, wherein the fin members of said wire stock formed by said second plurality of form roller members are angularly disposed at about 72 degrees apart relative to one another.

17. The machine of claim 16, wherein said fin members have a uniform, common width along their respective radial extents.

18. The machine of claim 17, wherein the common width of said fin members is about one-half the diameter of said central core.

19. The machine of claim 16, wherein the diameter of an imaginary circle coincident with the radially outermost ends of said fin members is about four times greater than the diameter of said central core.

20. The machine of claim 16, wherein the weight and quantity of wire stock in a preselected length thereof is about one-half the weight and quantity of a similar length of wire stock having a round cross section.

21. The machine of claim 16, wherein the surface area of a predetermined length of rebar made by said machine is about 86 percent greater than the surface area of a like length of rebar having a round cross section.

22. The machine of claim 16, wherein rebar made by said machine is cold-worked and as a result thereof has a tensile strength of about 120,000–150,000 pounds per square inch.

23. The machine of claim 1, further comprising:

a third form roller station longitudinally spaced apart from said second form roller station;

said third form roller station including a third plurality of form roller members having convex annular edges;

said third plurality of form roller members being equidistantly and circumferentially spaced relative to a path of travel of said wire stock; and said third plurality of form roller members further forming said wire stock by further reducing the diameter of said central core and further lengthening the respective radial dimensions of said fin members relative to the core diameter and fin dimension, respectively, imparted to said wire stock by said second plurality of form roller members.

24. The machine of claim 23, wherein the convex annular edges of said third plurality of form roller members have a radius of about 0.003–0.006 inch and form longitudinally extending bight means, having a like radius, along the extent of said wire stock.

25. The machine of claim 23, further comprising:

a plurality of transversely disposed notch members formed on the annular edges of each of said third plurality of roller members;

said notch members being equidistantly and circumferentially spaced about the respective annular edges of said third plurality of form roller members; and said notch members imparting a plurality of transversely disposed longitudinally spaced shoulder members along the extent of said wire stock.

26. The machine of claim 25, wherein the annular edges of said third plurality of roller members are roughened and have a microfinish of 30–120 microfinish units to impart a corresponding microfinish to wire stock worked by said roller members.

27. The machine of claim 26, wherein said roller member annular edges are roughened by acid washing.

28. The machine of claim 23, further comprising a cutting station including a plurality of cutting roller members disposed radially about a path of travel of said wire stock, each of said cutting roller members having at least one cutting means formed on its annular edge.

29. The machine of claim 23, wherein the fin members of said wire stock formed by said second plurality of form roller members are angularly disposed at about 85 degrees apart relative to one another.

30. The machine of claim 23, wherein the fin members of said wire stock formed by said third plurality of form roller members are angularly disposed at about 72 degrees apart.

31. A method of making rebars comprising the steps of:

feeding a substantially continuous length of wire along a predetermined path of travel;

forming a plurality of longitudinally extending, circumferentially disposed, substantially flat surfaces in said wire so that it has a polygonal cross section;

thereafter forming a plurality of circumferentially spaced concave bights in said wire by passing said wire through form roller means so that each bight is centered with respect to an associated flat surface so that metal is forced out of a core of said wire into plural fin-shaped projections that are separated from one another by said bights;

forming a plurality of equidistantly and circumferentially spaced, transversely disposed shallow notch means in the respective annular edges of said form roller means to form a corresponding plurality of transversely disposed raised shoulder means in said rebar as an anti-slipping means, each of said raised shoulder means extending across its associated bight.

32. The method of claim 31, further comprising the step of forming said flat surfaces with preform roller means having flat annular edges.

33. The method of claim 32, further comprising the step of arranging five of said preform roller means in equidistantly spaced, circumferential relation to one another and in radial disposition to said wire's path of travel, to preform said wire into a generally pentagonal cross section.

34. The method of claim 33, further comprising the step of arranging five of said form roller means in equidistantly spaced, circumferential relation to one another and in radial disposition to said wire's path of travel, to form said wire into a star shape having five radially projecting fin means with rounded edges.

35. The method of claim 34, further comprising the step of applying sufficient pressure to said wire with said form roller means to form five radial fins of tapered form which fins are spaced about 98 degrees from one another.

36. The method of claim 34, further comprising the step of applying sufficient pressure to said wire with said form roller means to form five radial fins having a common, uniform width along their respective radial extents which fins are angularly spaced about 72 degrees from one another.

37. The method of claim 36, further comprising the step of forming a plurality of equidistantly and circumferentially spaced, transversely disposed shallow notch means in the respective annular edges of said form roller means to form a corresponding transversely disposed shoulder means in said rebar as an anti-slipping means.

38. The method of claim 37, further comprising the step of configuring each of said notch means to have a relatively deep bight region flanked by a pair of diverging, gradually shallower regions that merge in a feather edge at their respective radially outermost ends with the annular edge of the form roller means within which said notch means is formed so that said rebar has complementally-formed shoulder members formed along its extent, each of which has a pair of diverging, transversely disposed arm members that merge in a feather edge with an associated fin and which converge in a bight region that is raised in relation to the bight region formed by said unnotched portions of said form roller means.

39. The method of claim 36, further comprising the step of cutting said wire at equidistantly spaced intervals by feeding it through a cutting station including plural cutting roller means disposed in radial relation to said wire's path of travel, and providing projecting cutting members on the respective annular edges of said cutting roller means which cooperate with one another to cut said wire.

40. The method of claim 31, further comprising the step of forming said flat surfaces into slight concavities by means of preform roller members having annular edges with slight convexities.

41. The method of claim 31, further comprising the step of forming said bights with form roller means having convex annular edges.

42. The method of claim 31, further comprising configuring each of said notch means to have a relatively deep bight region flanked by a pair of diverging, gradually shallower regions that merge in a feather edge at their respective radially outermost ends with the annular edge of the form roller means within which said notch means is formed so that said rebar has complementally-formed shoulder members formed along its extent, each of which has a pair of diverging, transversely disposed arm members that merge in a feather edge with an associated fin and which converge in a bight region that is raised in relation to the bight region formed by said unnotched portions of said form roller means.

43. The method of claim 31, further comprising the step of cutting said wire at equidistantly spaced intervals by feeding it through a cutting station including plural cutting roller means disposed in radial relation to said wire's path of travel, and providing projecting cutting members on the respective annular edges of said cutting roller means which cooperate with one another to cut said wire.

* * * * *